US008746913B2

(12) United States Patent
Tsai

(10) Patent No.: US 8,746,913 B2
(45) Date of Patent: Jun. 10, 2014

(54) LAVA LAMP HOLDER STRUCTURE IMPROVEMENT

(71) Applicant: Chien-Tsai Tsai, Taipei (TW)

(72) Inventor: Chien-Tsai Tsai, Taipei (TW)

(73) Assignee: Su-Fang Ho, New Taipei (TW)

( * ) Notice: Subject to any disclaimer, the term of this patent is extended or adjusted under 35 U.S.C. 154(b) by 98 days.

(21) Appl. No.: 13/622,472

(22) Filed: Sep. 19, 2012

(65) Prior Publication Data

US 2014/0078721 A1 Mar. 20, 2014

(51) Int. Cl.
*F21V 33/00* (2006.01)

(52) U.S. Cl.
USPC ..... 362/101

(58) Field of Classification Search
USPC ..... 362/101, 811
See application file for complete search history.

(56) References Cited

U.S. PATENT DOCUMENTS

| | | | | |
|---|---|---|---|---|
| 5,803,580 | A * | 9/1998 | Tseng | 362/96 |
| 5,860,732 | A * | 1/1999 | Coleman et al. | 362/253 |
| 6,241,359 | B1 * | 6/2001 | Lin | 362/96 |
| 7,871,173 | B2 * | 1/2011 | Lin et al. | 362/101 |

* cited by examiner

*Primary Examiner* — Evan Dzierzynski
(74) *Attorney, Agent, or Firm* — Rosenberg, Klein & Lee

(57) ABSTRACT

The invention relates to a lava lamp holder structure improvement, particularly to lamp holder structure combining a lava lamp and lighting, comprising: a holder, a joint sleeve and a transparent bottle. The holder having a base, a first mounted seat with a projection lamp mounted at an inner periphery thereof, a second mounted seat with a lighting lamp mounted on a top thereof and a support bracket having a wire arranged therein for connecting to the lighting lamp. The joint sleeve has an internal sleeve and an external sleeve and an annular heat insulation space formed between the internal sleeve and the external sleeve for heat dissipation. The transparent bottle has filler with two immiscible liquid therein and is arranged between the second mounted seat and the joint sleeve.

7 Claims, 8 Drawing Sheets

LAVA LAMP HOLDER STRUCTURE IMPROVEMENT

BACKGROUND OF THE INVENTION

1. Field of the Invention

The invention relates to a lava lamp holder structure improvement, particularly to a lamp holder structure combining a lava lamp and lighting functions.

2. Description of the Related Art

Since the sixties of the last century, lava lamps have become a common device in the worldwide university student dormitories and teenage children bedrooms. Lava lamps have been deeply implanted into the popular culture of the United States and many other countries.

With reference to FIG. 1, U.S. Pat. No. 3,570,156 discloses a lava lamp display device 40 comprising: a glass vessel 41 having a bottom 42 arranged in a hollow conical metallic seating 43 and located on an electric light bulb 44. Moreover, the glass vessel 41 has two immiscible components such as liquid 45 and a paraffin 46 which has a higher density than the liquid 45 at room temperature and a lower density than the liquid 45 after heating. After the electric light bulb 44 is turned on, the paraffin 46 in the bottom 42 of the glass vessel 41 is heated and flows in the liquid 45. At the same time, the electric light bulb 44 projects the light in the glass vessel 41, forming a lighting effect and becoming decorations at home and office.

The principle of the lava lamp is to provide a heat from a bulb for the two kinds of immiscible liquid with different specific gravity within the container to produce convection and the floating objects within the liquid moves up and down. Under the illumination of the projection light, the floating objects float and sink, producing brilliant and vivid visuals.

However, lava lamps have been only for decoration function. Under the long-time use of the lava lamp, the bulb with high temperature is easy to cause a serious burn for those who touch the bulb. Moreover, the transparent container without stable installation structure is easily overturned and broken, which allows the internal liquid to harm human body. Therefore, the present invention is provided for increasing the lava lamp using function, isolating the heat of long-term use of the lava lamp, and enhancing the safety and convenience of the lava lamp.

SUMMARY OF THE INVENTION

It is the first primary object of the present invention to provide a lava lamp holder structure improvement combining lighting and decoration functions and to provide a holder with positioning points for stabilizing a transparent bottle.

It is the second object of the present invention to provide a lamp holder structure combining heat concentration and heat insulation functions.

It is the last object of the present invention to provide a lamp holder structure with a lava lamp transparent bottle which is easy to be installed and removed for increasing the convenience and security effects.

In order to achieve the above objects, the lava lamp holder structure improvement comprises: a holder, a joint sleeve and a transparent bottle.

The holder includes a base, a first mounted seat, a second mounted seat, and a support bracket. The base is arranged at a bottom of the holder for placing on a table or floor. The first mounted seat has a bottom mounted on the base and a first containing room with an upward opening at an inner periphery thereof and the first containing room has a first lamp seat therein for mounting an upward projection lamp. The second mounted seat is arranged on a top of the holder and has a second containing room with a downward opening at an inner periphery thereof and a second lamp seat on a top thereof for mounting a lighting lamp. The support bracket has an end connecting to a lower end of the holder and another end connecting to the second mounted seat for centers of the first mounted seat and second mounted seat to be vertically located on an axis of the base, being in an up-down corresponding state, and a wire is arranged in an internal part of the support bracket for connecting to the lighting lamp.

The joint sleeve has an internal sleeve and an external sleeve. The internal sleeve includes a hollow containing room at an inner periphery thereof and an annular heat insulation space is formed between the internal sleeve and the external sleeve. The joint sleeve includes an inserted section at a lower end thereof for inserting into the first containing room of the first mounted seat so that the joint sleeve is securely mounted on the first mounted seat.

The transparent bottle has a filler with two immiscible liquid therein and an inserted section at a lower end thereof. The inserted section of the transparent bottle has an external diameter slightly smaller than an external diameter of the transparent bottle. The transparent bottle is arranged between the second mounted seat and the joint sleeve and has a moderate distant between a bottom thereof and the projection lamp and an upper end penetrated into the second containing room of the second mounted seat and the penetration depth is sufficient for the inserted section of the transparent bottle to be penetrated into the hollow containing room of the joint sleeve so that the transparent bottle in a vertical position is securely installed between the second containing room and the hollow containing room of the holder.

Whereby the required lighting is available through the lighting lamp; the transparent bottle is turned into lava lamp visual effects through an illumination of the projection lamp; the heat generated by the projection lamp is isolated by the heat insulation space and the height between the second containing room of the second mounted seat and the hollow containing room of the joint sleeve is slightly higher than the height of the transparent bottle such that the transparent bottle is easy to be installed and removed.

DETAILED DESCRIPTION OF THE PREFERRED EMBODIMENT

Figure 1:
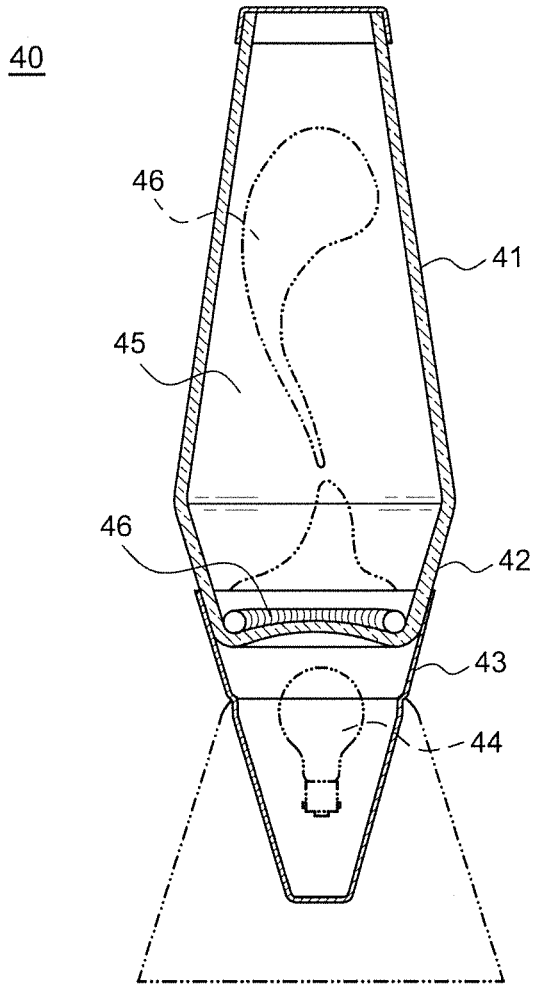
FIG.1 PRIOR ART
FIG. 1 is a schematic view of a conventional lava lamp device.
Figure 2:
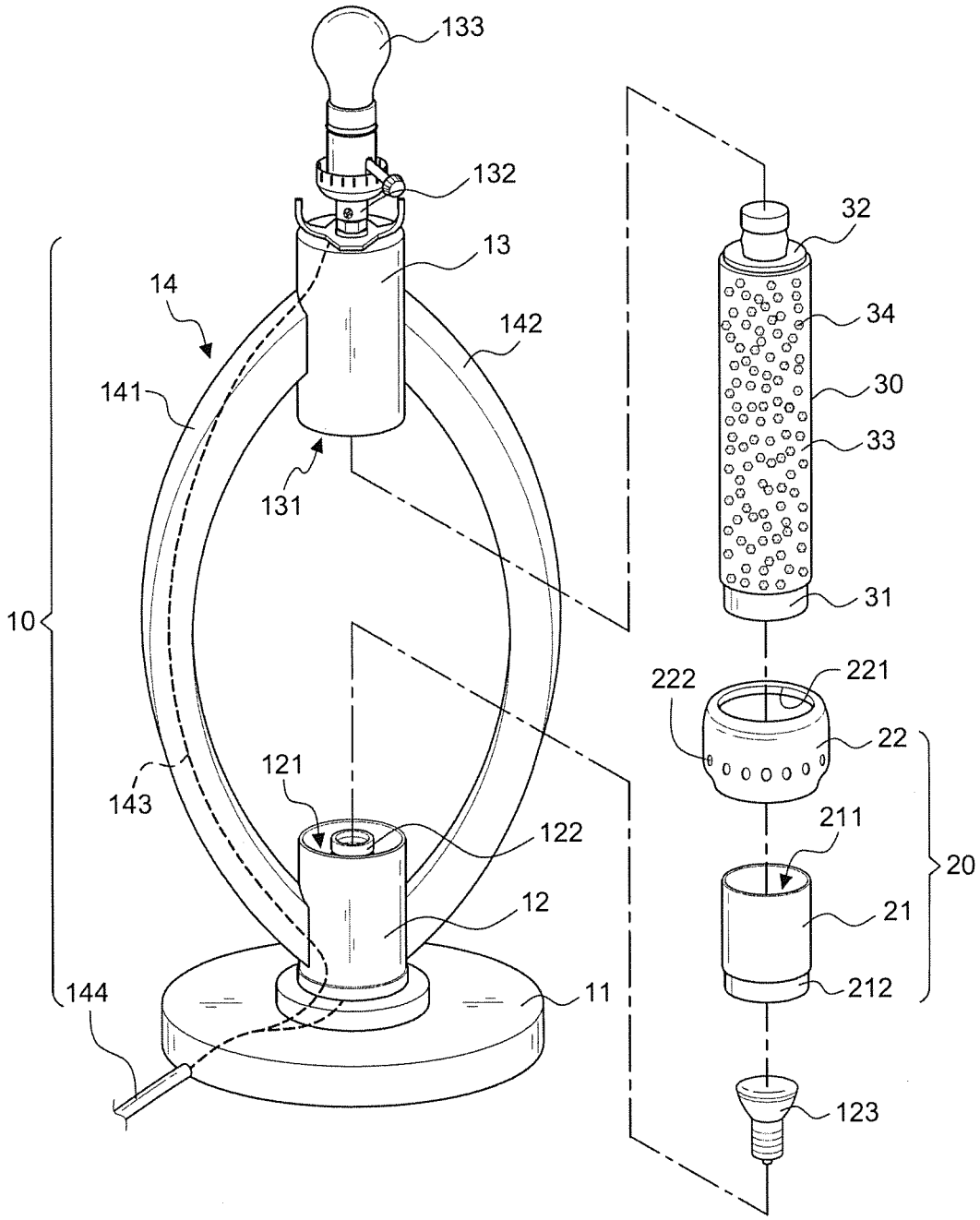
FIG. 2 is an exploded perspective view of a preferred embodiment in accordance with the present invention.

Referring to FIGS. 2 through 7, the preferred embodiment of a lava lamp holder structure improvement in accordance with the present invention comprises: a holder 10 having a base 11 on a bottom thereof for placing on a ground or desktop; a first mounted seat 12 having a bottom mounted on the base 11 and a first containing room 121 with an upward opening at an inner periphery thereof and the first containing room 121 having a first lamp seat 122 therein for mounting an upward projection lamp; a second mounted seat 13 arranged on a top of the holder 10 and having a second containing room 131 with a downward opening at an inner periphery thereof; a second lamp seat 132 arranged on a top of the second mounted seat 13 for mounting a lighting lamp 133; a support bracket 14 having an end connecting to a lower end of the holder 10 and another end connecting to the second mounted seat 13 for centers of the first mounted seat 12 and second mounted seat 13 to be vertically located on an axis of the base 11, being in an up-down corresponding state, and a wire 143 arranged in an internal part of the support bracket 14 for connecting to the lighting lamp 133.

Figure 6:
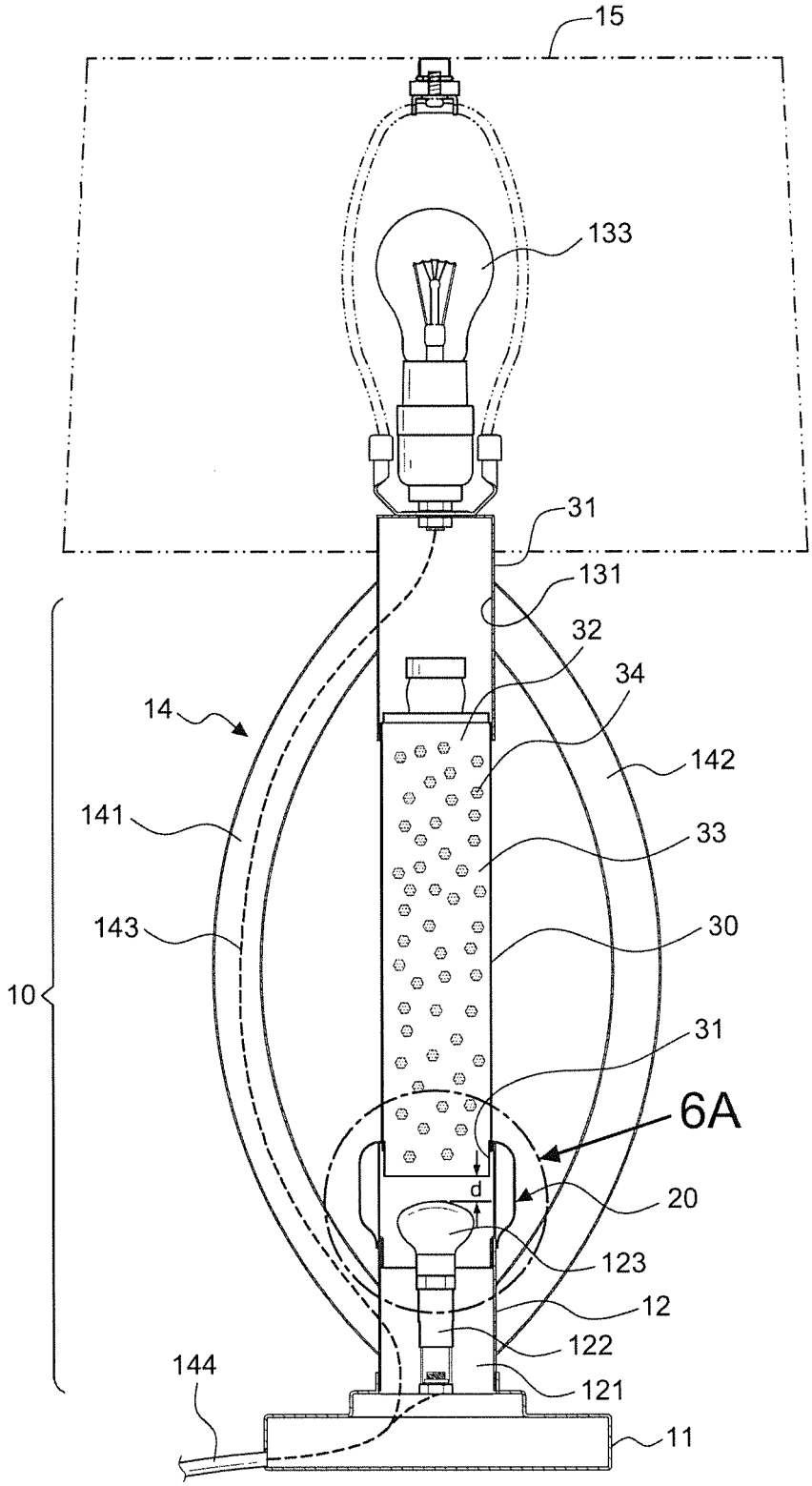
FIG. 6 is a sectional view of a preferred embodiment in accordance with the present invention, illustrating in an assembly state.

In the preferred embodiment as shown in FIG. 6, the support bracket 14 in an elliptical shape is composed of symmetrical left arc-shaped tube 141 and right arc-shaped tube 142 and includes a lower end fixed on an external side of the first mounted seat 12 and upper end fixed on an external side of the second mounted seat 13 so that the centers of the first mounted seat 12 and second mounted seat 13 are vertically located on an axis of the base 11 for increasing an artistic view. With the reference to FIG. 6, the wire 143 is arranged in the left arc-shaped tube 141 for connecting to the lighting lamp 133 and a power cord 144.

Figure 7:
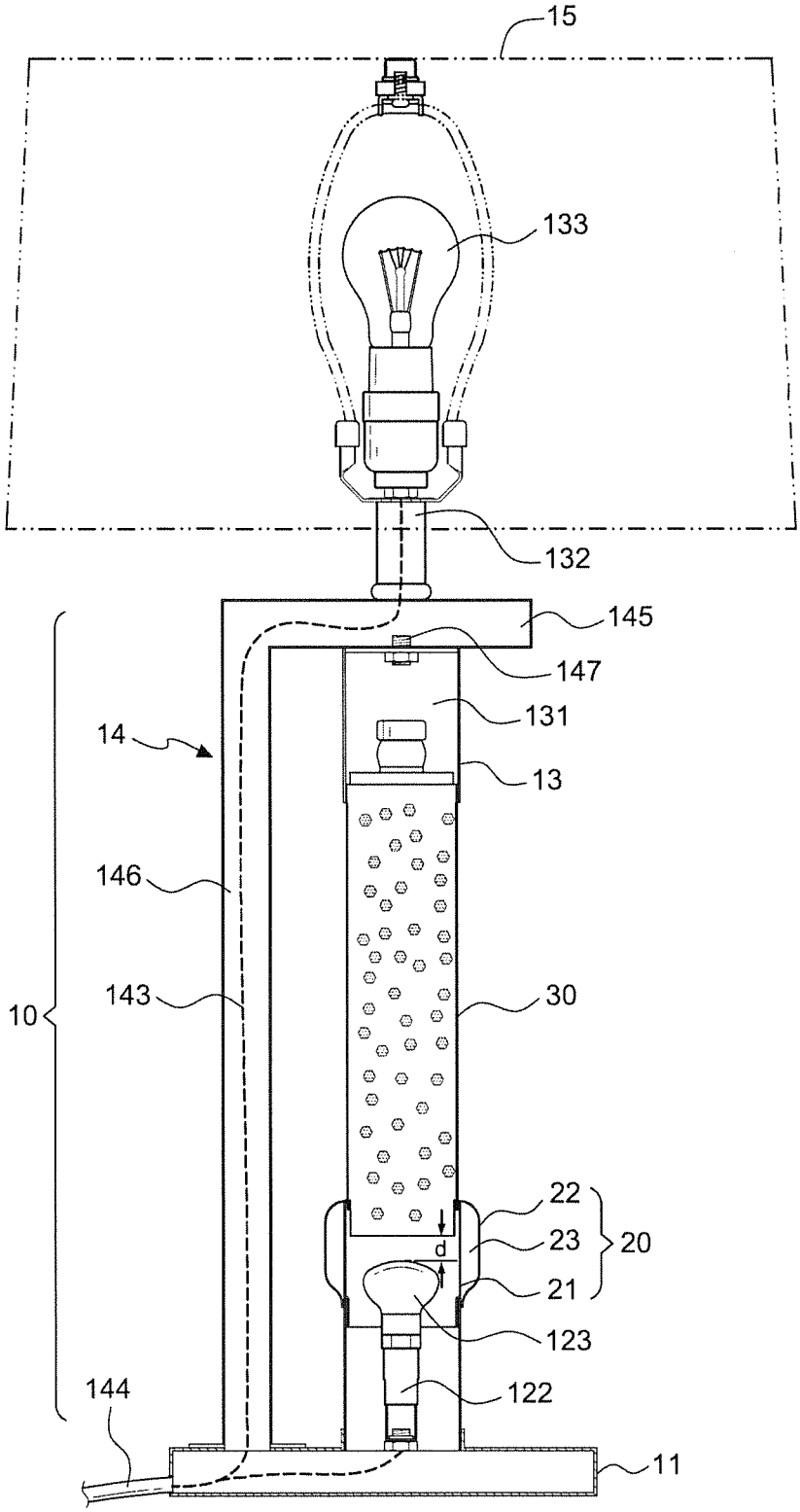
FIG. 7 is a sectional view of another preferred embodiment in accordance with the present invention, illustrating in an assembly state.

Another preferred embodiment as shown in FIG. 7, the support bracket 14 in an inverted L-shaped is composed of a transverse tube 145 and vertical tube 146. The vertical tube 146 has a lower end fixed on an upper side of the base 11 and the second mounted seat 13 has an upper end fixed on an lower end of the transverse tube 145 by a screw 147 so that the centers of the first mounted seat 12 and second mounted seat 13 are vertically located on an axis of the base 11 for increasing artistic view. With the reference to FIG. 7, the wire 143 is arranged in the transverse tube 145 and vertical tube 146 for connecting to the lighting lamp 133 and a power cord 144. With the references to FIGS. 6 and 7, the present invention has a lampshade arranged on a top of the second lamp seat 132 for lighting.

Figure 6A:
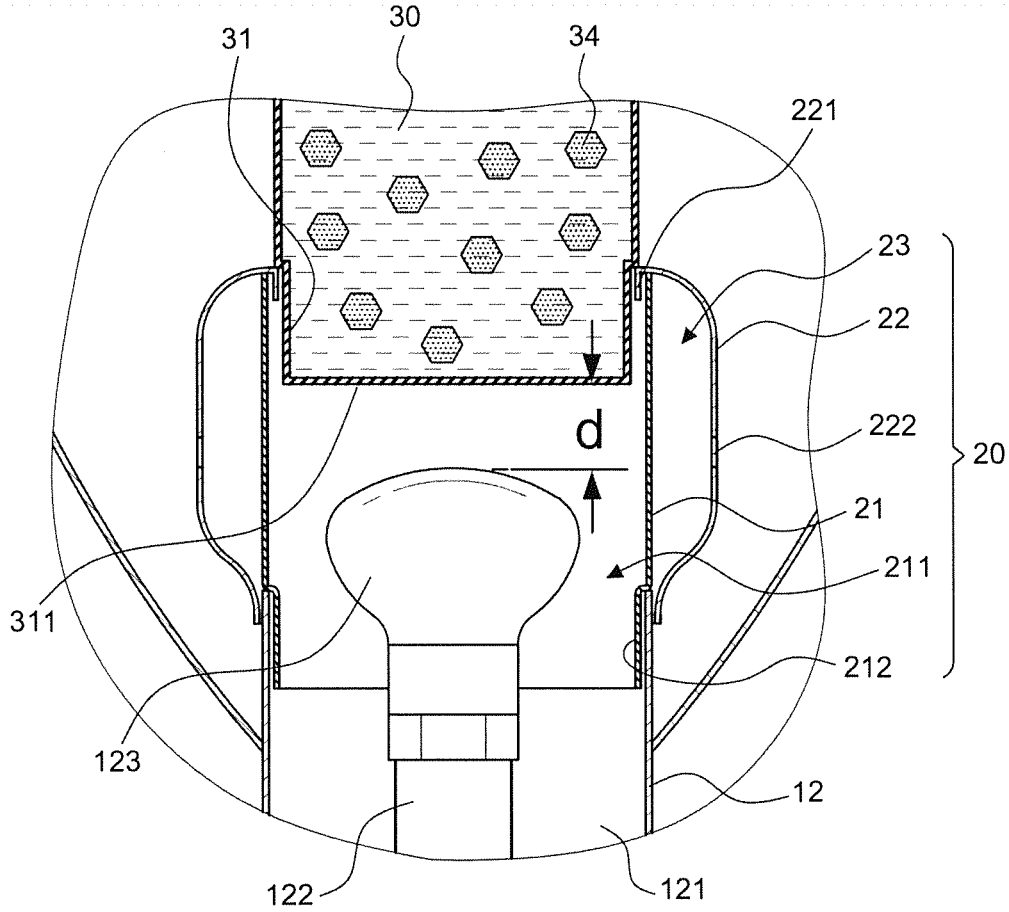
FIG. 6A is an enlarged sectional view of 6A in FIG. 6.

With the reference to FIG. 6A, a joint sleeve 20 has an internal sleeve 21 and an external sleeve 22. In this embodiment, the internal sleeve 21 and the external sleeve 22 are separately formed and then combined into the joint sleeve 20 but it is not a limitation; that is, the internal sleeve 21 and the external sleeve 22 may be integrally molded. The internal sleeve 21 includes a hollow containing room 211 at an inner periphery thereof. The joint sleeve 20 includes an inserted section 212 at a lower end thereof. At the same time, an external diameter of the inserted section 212 is lightly smaller the an external diameter of an upper end of the external sleeve 22 for the inserted section to be inserted into the first containing room 121 of the first mounted seat 12 and an internal diameter of the external sleeve 22 is slightly larger than the external diameter of the inserted section 212. The upper end of the external sleeve 22 has an inward lip 221 for holding an upper end of the internal sleeve 21 while the internal sleeve 21 is mounted in the external sleeve 22. Moreover, an annular heat insulation space 23 is formed between the internal sleeve 21 and the external sleeve 22 and the external sleeve 22 has a plurality of air vents 222 at circumference thereof for heat dissipation.

In the preferred embodiment, the internal sleeve 21 has no air vents at circumference thereof so that the heat generated by the projection lamp 123 is concentrated in the internal sleeve 21. On the other hand, the external sleeve 22 has air vents 222 at circumference thereof so that the external sleeve 22 is not too high to burn human body.

With the reference to FIGS. 6 and 6A, a transparent bottle 30 has a filler 33 with two immiscible liquid therein. The filler 33 of the transparent bottle 30 may include liquid, paraffin having a higher density than the liquid, or mineral oil which is a prior art and thus will not be described in details here. In the preferred embodiment, the transparent bottle 30 may further include a plurality of paillettes 34. With the reference to FIGS. 6 and 6A, the transparent bottle has an inserted section 31 at a lower end thereof and the inserted section 31 of the transparent bottle 30 has an external diameter slightly smaller than an external diameter of the transparent bottle 30. Moreover, the transparent bottle 30 is arranged between the second mounted seat 13 and the joint sleeve 20 and has a moderate distant d between a bottom 311 thereof and the projection lamp 123.

Figure 3:
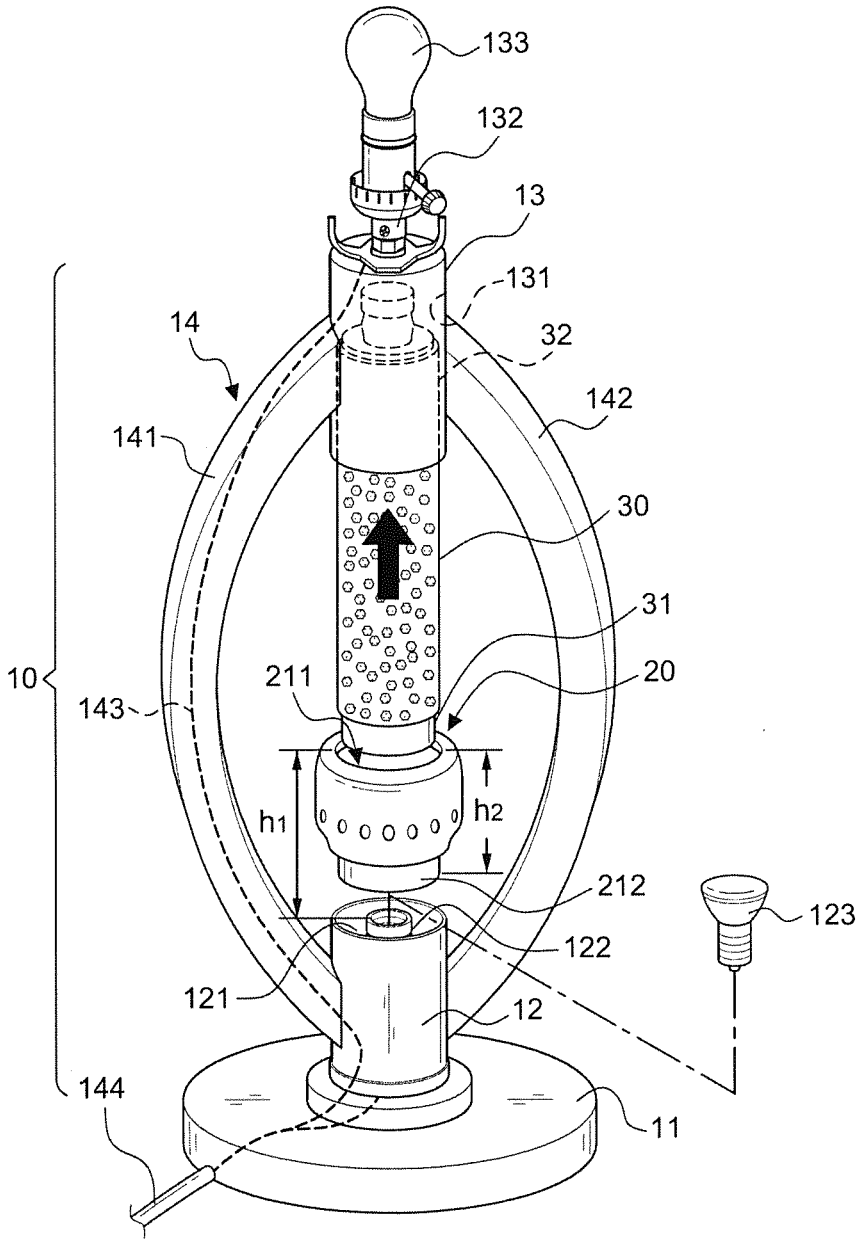
FIG. 3 is a schematic view of a preferred embodiment in accordance with the present invention, illustrating step 1 of a transparent bottle installation.
Figure 4:
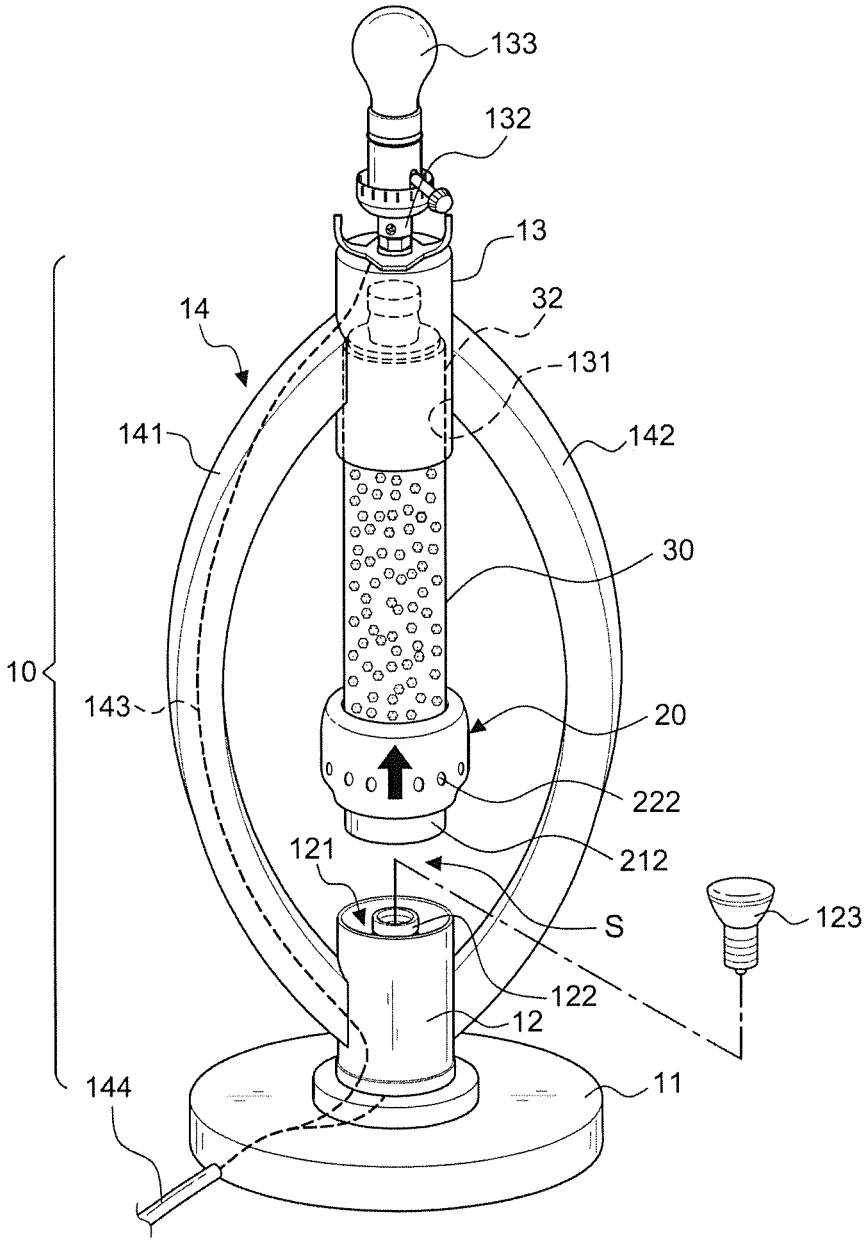
FIG. 4 is a schematic view of a preferred embodiment in accordance with the present invention, illustrating step 2 of a transparent bottle installation.
Figure 5:
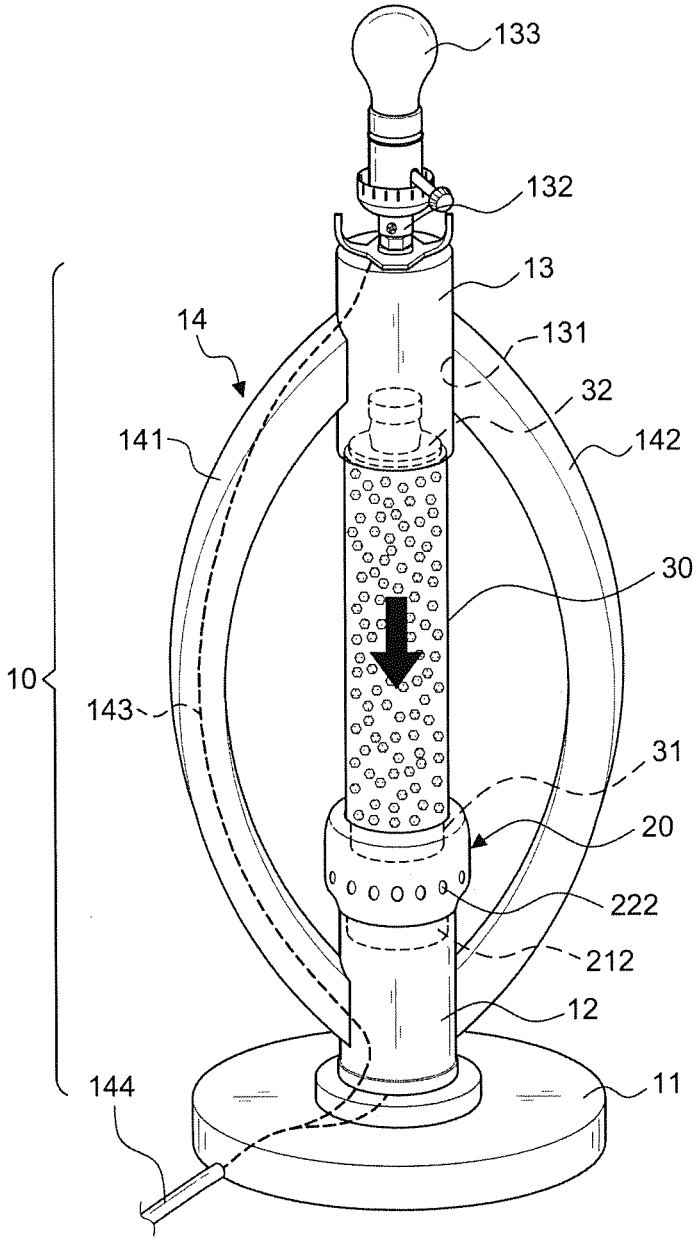
FIG. 5 is a schematic view of a preferred embodiment in accordance with the present invention, illustrating step 3 of a transparent bottle installation.

When installing the transparent bottle 30, the first step as shown in FIG. 3 is to penetrate an upper end 32 of the transparent bottle 30 into the second containing room 131 of the second mounted seat 13 for having a gap of a height h1 between the lower end of the inserted section 31 of the transparent bottle 30 and the upper end of the first mounted seat 12, which is taller than a height h2 of the joint sleeve 20. The second step as shown in FIG. 4 is to penetrate the hollow containing room 211 of the joint sleeve 20 into the inserted section 31 of the transparent bottle 30 so that the bottom of the joint sleeve 20 to the first mounted seat form a space S for installing the projection lamp 123. The third step as shown in FIG. 5 is to move the transparent bottle 30 and the projection lamp 123 downward for the inserted section 212 of the joint sleeve 20 to be penetrated into the first containing room 121. Due to the upper end 32 of the transparent bottle 30 is coated by the second containing room 131 of the second mounted seat 13 and the inserted section 31 is coated by the lip 221 of the joint sleeve 20, the transparent bottle 30 as shown in FIG. 6 in a vertical position is securely installed between the second containing room 131 and the hollow containing room 211. Comparing to the conventional lava lamp 40 as shown in FIG. 1, the present invention with two positioning points on the top and bottom ends of the holder 10 provides safety. A user can follow the first step to the third step in the reverse order to remove the transparent bottle 30.

Whereby the required lighting is available through the lighting lamp 133; the transparent bottle 30 is turned into lava lamp visual effects through an illumination of the projection lamp 123; the heat generated by the projection lamp 123 is isolated by the heat insulation space 23 and the height between the second containing room 131 of the second mounted seat 13 and the hollow containing room 211 of the joint sleeve 20 is slightly higher than the height of the transparent bottle 30 such that the transparent bottle 30 is easy to be installed and removed.

Based on the features disclosed, the present invention provides the lava lamp holder structure to combine heat insulation and heat dissipation functions and a lamp holder structure with a lava lamp transparent bottle which is easy to be installed and removed for increasing the convenience and security effects.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lava lamp holder structure improvement, particularly to lamp holder structure combining a lava lamp and lighting, comprising:

a holder having a base on a bottom thereof; a first mounted seat having a bottom mounted on the base and a first containing room with an upward opening at an inner periphery thereof and the first containing room having a first lamp seat therein for mounting an upward projection lamp; a second mounted seat arranged on a top of the holder and having a second containing room with a downward opening at an inner periphery thereof; a second lamp seat arranged on a top of the second mounted seat for mounting a lighting lamp; a support bracket having an end connecting to a lower end of the holder and another end connecting to the second mounted seat for centers of the first mounted seat and second mounted seat to be vertically located on an axis of the base, being in an up-down corresponding state, and a wire arranged in an internal part of the support bracket for connecting to the lighting lamp;

a joint sleeve having an internal sleeve and an external sleeve, the internal sleeve including a hollow containing room at an inner periphery thereof, an annular heat insulation space formed between the internal sleeve and the external sleeve and the joint sleeve including an inserted section at a lower end thereof for inserting into the first containing room of the first mounted seat so that the joint sleeve is securely mounted on the first mounted seat; and a transparent bottle having a filler with two immiscible liquid therein and an inserted section at a lower end thereof, the inserted section of the transparent bottle having an external diameter slightly smaller than an external diameter of the transparent bottle, the transparent bottle arranged between the second mounted seat and the joint sleeve and having a moderate distant between a bottom thereof and the projection lamp and the transparent bottle having an upper end penetrated into the second containing room of the second mounted seat and the penetration depth being sufficient for the inserted section of the transparent bottle to be penetrated into the hollow containing room of the joint sleeve so that the transparent bottle in a vertical position is securely installed between the second containing room and the hollow containing room;

whereby the required lighting is available through the lighting lamp; the transparent bottle is turned into lava lamp visual effects through an illumination of the projection lamp; the heat generated by the projection lamp is isolated by the heat insulation space and the height between the second containing room of the second mounted seat and the hollow containing room of the joint sleeve is slightly higher than the height of the transparent bottle such that the transparent bottle is easy to be installed and removed.

2. The lava lamp holder structure improvement as claimed in claim 1, wherein the external sleeve has a plurality of air vents at circumference thereof.

3. The lava lamp holder structure improvement as claimed in claim 1, wherein the filler of the transparent bottle includes liquid, paraffin having a higher density than the liquid, or mineral oil.

4. The lava lamp holder structure improvement as claimed in claim 3, wherein the transparent bottle further includes a plurality of paillettes.

5. The lava lamp holder structure improvement as claimed in claim 1, wherein the support bracket in an elliptical shape is composed of symmetrical left arc-shaped tube and right arc-shaped tube and includes a lower end fixed on an external side of the first mounted seat and upper end fixed on an external side of the second mounted seat.

6. The lava lamp holder structure improvement as claimed in claim 1, wherein the support bracket in an inverted L-shaped is composed of a transverse tube and vertical tube and includes a lower end fixed on an upper side of the base and an upper end with up-down sides respectively connecting to the second lamp seat and the second mounted seat.

7. The lava lamp holder structure improvement as claimed in claim 1, further comprising a lampshade arranged on a top of the second lamp seat.

* * * * *